United States Patent [19]

Nowakowski et al.

[11] Patent Number: 4,869,245

[45] **Date of Patent: * Sep. 26, 1989**

[54] AUTOMATIC RELEASE MECHANISM FOR A BREATHING MASK

[75] Inventors: Donald E. Nowakowski; Carlton W. Naab, both of Safety Harbor, Fla.

[73] Assignee: Conax Florida Corporation, St. Petersburg, Fla.

[ * ] Notice: The portion of the term of this patent subsequent to Feb. 14, 2006 has been disclaimed.

[21] Appl. No.: 109,704

[22] Filed: Oct. 16, 1987

Related U.S. Application Data

[63] Continuation-in-part of Ser. No. 922,075, Oct. 20, 1986, Pat. No. 4,803,980.

[51] Int. Cl.[4] ..... A62B 17/04; B63C 11/02; A42B 3/00

[52] U.S. Cl. ..... 128/201.23; 2/6; 2/422; 24/602; 128/202.27

[58] Field of Search ..... 24/602, 603; 2/2.1 A, 2/2.5, 6, 173, 421, 422, 424; 128/201.23, 201.24, 202.11, 202.27; 361/251

[56] References Cited

U.S. PATENT DOCUMENTS

| | | | |
|---|---|---|---|
| 2,867,812 | 1/1959 | Roth et al. | 2/6 |
| 3,035,573 | 5/1962 | Morton, Jr. et al. | 128/201.23 |
| 3,123,831 | 3/1964 | Wells et al. | 128/201.23 X |
| 3,473,166 | 10/1969 | Lobelle | 128/201.24 X |
| 3,872,556 | 3/1975 | Frost | 24/603 |
| 4,024,440 | 5/1977 | Miller | 361/251 |
| 4,086,685 | 5/1978 | Gaylord | 24/603 X |
| 4,447,084 | 5/1984 | Jankowiak et al. | 24/603 X |
| 4,488,546 | 12/1984 | Bernhardt et al. | 128/201.23 |
| 4,513,248 | 4/1985 | Miller | 361/251 X |
| 4,637,101 | 1/1987 | Fiedler | 24/602 |
| 4,689,834 | 9/1987 | McCarthy et al. | 2/64 R |

FOREIGN PATENT DOCUMENTS

| | | | |
|---|---|---|---|
| 2414339 | 9/1979 | France | 24/602 |

*Primary Examiner*—Wm. Carter Reynolds

*Attorney, Agent, or Firm*—Christel, Bean & Linihan

[57] ABSTRACT

An expolosively-activated mechanism for releasing a breathing mask from a protective helmet to permit the user to breathe the ambient atmosphere independently of the mask utilizes coacting mechanisms in the form of a bayonet and a bayonet receiver and an explosive charge mounted in the bayonet receiver for explosively separating the bayonet receiver and permitting the bayonet to drop from the helmet upon the occurrence of a predetermined event. The bayonet receiver includes components defining a bayonet-receiving channel which is held in assembled relationship by a plurality of shanked fasteners and a cutting blade interposed between the explosive charge and the shanked fasteners. The cutting blade is adapted to receive the explosive force generated by the explosive charge and sever every shanked fastener of the bayonet receiver upon receipt of the explosive force. The component-holding capacity of the fasteners are thereby destroyed, and the receiver components are permitted to separate from one another and the bayonet is permitted to drop from the receiver. The explosive force of the charge is substantially confined within the bayonet receiver.

32 Claims, 2 Drawing Sheets

AUTOMATIC RELEASE MECHANISM FOR A BREATHING MASK

This is a continuation-in-part of copending application serial number 922,075 filed on Oct. 20, 1986 now U.S. Pat. No. 4,803,980.

BACKGROUND OF THE INVENTION

This invention relates to an explosively-actuated mechanism automatically operable upon the occurrence of a predetermined event to release a breathing mask from a protective helmet sufficiently to enable the user to breathe the ambient atmosphere independently of the mask.

Pilots and other aircraft crew members customarily are provided with breathing mask-protective helmet arrangements wherein the mask is releasably secured to the helmet in a manner positioning the mask snugly against the face of the wearer. Typically, such arrangements include a mask mounting harness terminating at opposite ends in bayonet connectors which cooperate with bayonet-receiving means mounted on opposite sides of the helmet for releasably securing the mask to the helmet. Each bayonet commonly includes spring fingers, and each bayonet-receiving means includes a cover plate and other components held together in assembled relationship defining a bayonet-receiving channel for accepting the bayonet and which interlock with the spring fingers when the bayonet is operatively positioned within the channel. The aviator is thereby enabled to push each bayonet into its corresponding bayonet-receiving channel until the mask fits comfortably and snugly against the face, and the bayonet-receiving means serves to lock the mask in such position of use. The mask typically is provided with a face-contacting cushion of resilient material which is compressed against the face of the user to provide a seal when the mask is locked in such position of use. The bayonets are provided with a manually-actuated release mechanism so that the aviator can manually release the bayonets from the helmet-mounted receivers. Typically such mechanisms include a release bar carried by the bayonet which bar is manually shiftable relative to the bayonet to retract the spring fingers and thereby release the interlock, the release bar having a manually engageable member externally of the bayonet-receiving means for that purpose.

Breathing gas is supplied to the interior of the mask through a hose connected at one end to the mask and having its other end connected through a quick disconnect coupling to a source of breathing fluid carried by the aircraft. Upon ejection of the aviator from the aircraft, the hose is released from its source connection, remaining attached to the mask as the aviator descends. This presents a potential problem if the aviator descends into water, because of the need to separate the mask from his face. While the manual release mechanism presumably will remain operative, often the aviator will be unconscious or injured and unable to manually release the mask. In that event, he can breath only through the mask and attached hose, and will inhale water and shortly drown if the mask remains secured against his face.

U.S. Pat. No. 4,488,546 dated Dec. 18, 1984 discloses a connector associated release mechanism automatically operable upon immersion in water to shift the release bar mechanism in a manner simulating manual actuation thereof. To this end, a normally rigid water sensitive element is provided which loses its rigidity in water, permitting a compression spring to relax and thereby shift the release bar mechanism to disengage the spring fingers.

Pending U.S. patent application Ser. No. 922,075, filed Oct. 20, 1986, now U.S. Pat. No. 4,803,980, entitled AUTOMATIC BREATHING MASK RELEASE MECHANISM and having the same assignee as the present application discloses an automatic release mechanism which is incorporated into the bayonet-receiving means on the helmet for automatically and explosively separating the bayonet from the bayonet-receiving means in response to the occurrence of a predetermined event, such as the presence of water. The mechanism includes an explosive cartridge and an associated piston mounted within the bayonet-receiving means. When activated, the explosive charge drives the piston at generally a right angle against the bayonet, driving the latter against the cover to separate the latter from the bayonet-receiving means and eject the bayonet from its receiving channel, all independently of the manually actuated release mechanism. Reference is made to said application for a more detailed description of the disclosed automatic release mechanism.

The explosively activated release mechanism of application Ser. No. 922,075 has particular utility where it is desired to ensure release of the mask by a positive displacement action as described above.

In some instances it is desired to provide the positive action achieved with an explosively activated mechanism in a more contained arrangement, and that is accomplished by the present invention.

It is an object of the present invention to provide an explosively-activated mechanism for releasing a breathing mask from a protective helmet in a relatively confined and contained manner.

Another object of the present invention is to provide the foregoing in a mechanism which achieves the desired mask separation while reducing the likelihood that any portion of the bayonet-receiving means or of the bayonet is forceably propelled away from the helmet by the explosive action of the mechanism.

Still another object of the present invention is to provide such a mechanism wherein components of the bayonet-receiving means are separated by the explosive force of the mechanism, when activated, and the resilient action of the mask cushion against the face is utilized to assist in thereupon separating the bayonet from its receiving means.

Yet another object of the present invention is to provide the foregoing in a mechanism which is relatively uncomplicated, highly dependable and which operates independently of the manually actuated release and is totally compatible with the environment of its intended use.

SUMMARY OF THE INVENTION

The mechanism of this invention is characterized by the provision of coacting means for releasably securing the mask to the helmet in a position of use against the wearer's face and explosively-activated means operatively associated with the coacting means for separating the same to thereby release the mask from the helmet, in an arrangement adapted to substantially confine the explosive force whereby no part of the coacting means or the mask is forceably propelled from the helmet by the explosive force. Release of the mask from the helmet is aided by the resilient force exacted by the mask which normally is compressed against the wearer's face when in use.

BRIEF DESCRIPTION OF THE DRAWING FIGURES

DETAILED DESCRIPTION OF THE ILLUSTRATED EMBODIMENT

Figure 1:
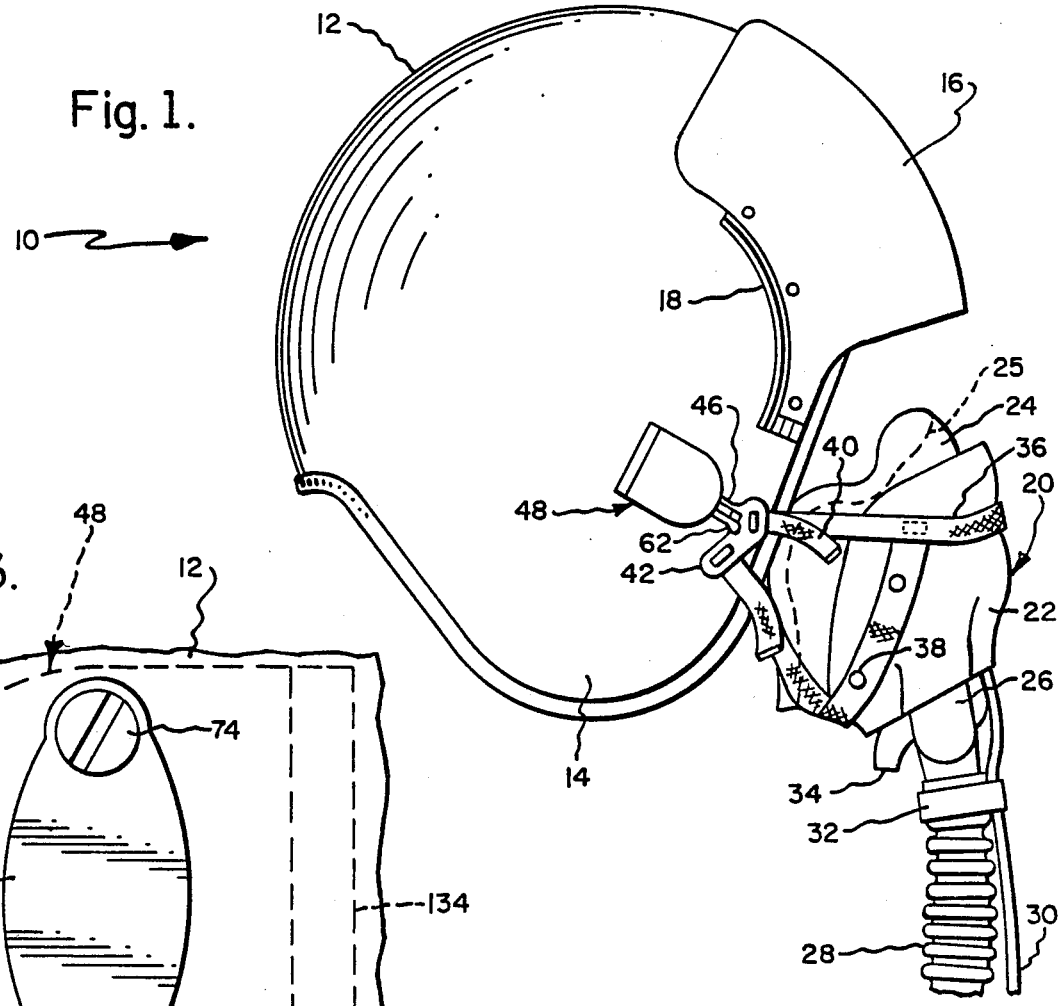
FIG. 1 is an elevational view showing a conventional breathing mask connected to an aviator's helmet in a manner positioning the mask against the face of the user (not shown), the helmet carrying a bayonet receiver incorporating an automatic mask releasing mechanism of this invention.
Figure 3:
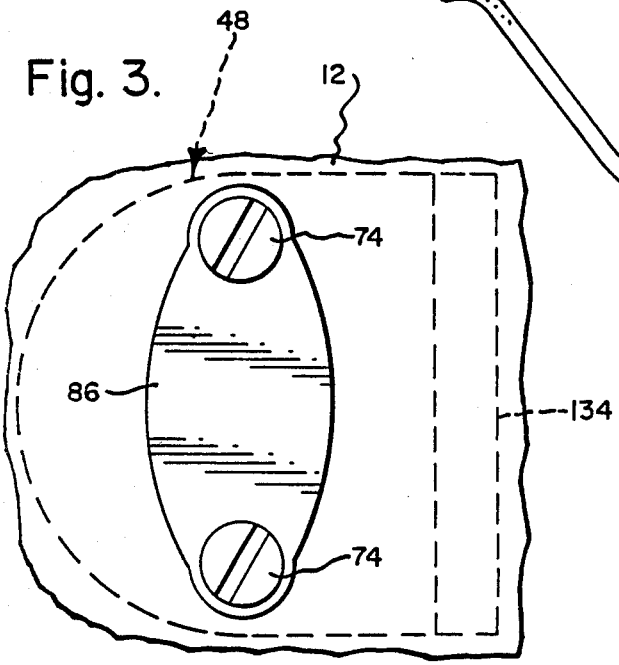
FIG. 3 is an elevational view of the bayonet receiver mounting arrangement as seen within the helmet taken about on line 3—3 of FIG. 4.

FIG. 1 illustrates a helmet and breathing mask arrangement in which an automatic release mechanism of this invention is incorporated. The helmet, generally designated 10, comprises a shell 12, an ear cover portion 14 on each side of the helmet shell 12 and a cover 16 for a visor (not shown) which is movable on a track 18 to and from a retracted position beneath the cover 16. The breathing mask, generally designated 20, comprises a body 22 shaped to fit over the mouth and nose of the aviator's face and includes a nosepiece formation 24 in the upper region of the body 22 as viewed in FIG. 1 and an inlet formation 26 in the lower region thereof. Inlet 26 is in fluid communication with one end of a hose 28 for supplying breathing gas to the interior of the mask 20.

Commonly, the hose 28 is connected at its lower end by a quick disconnect coupling (not shown) to a source, such as a tank (not shown), of breathing gas in the aircraft. When the aviator is ejected from the aircraft during an emergency, the end of hose 28 is disconnected from the source tank, and the length of hose 28 remains connected at its other end to mask 20 and travels with the aviator as he descends by parachute. A cable 30 connected to hose 28 by clamp 32 leads at one end into the mask 20 and comprises a plurality of conductors for electrical connection to a microphone (not shown) in mask 20 and an earphone (not shown) in helmet 10. The other end of cable 30 normally is connected to communications equipment in the aircraft and is disconnected therefrom when the pilot ejects and travels with him during descent. The mask also includes exhaust outlet 34 in the lower portion thereof which is provided with a check valve (not shown) through which the pilot expels air. All of the foregoing is conventional and well known in the art.

Mask 20 is releasably connected to the helmet 10 in the following manner. The mask body 22 is received in a harness comprising straps 36 which are secured to the mask body 22 by fasteners 38. On each side of mask 20, strap 36 terminates in two free ends 40 which are looped through or otherwise connected in corresponding slots near opposite ends of a transverse arm or bar formation 42 at one end of a bayonet finger or connector 46. The other end of bayonet 46 is releasably engaged in a bayonet receiver, generally designated 48, mounted on the exterior surface of the helmet shell 12 near the front and upwardly of the ear covering portion 14 thereof.

On the side of mask 20 and helmet 10 not shown in FIG. 1, there is provided a similar arrangement of strap ends 40 connected to a transverse arm or bar formation, like that shown at 42, at one end of a bayonet finger or connector corresponding to that shown at 46, engaged in a receiver mounted on the exterior surface of the helmet shell 12 and having a bayonet receiving channel and spring finger interlock like receiver 48 shown in FIG. 1 and described in detail hereafter. However, an automatic release mechanism of this invention need be incorporated in only the one bayonet receiver 48 shown in FIG. 1 and illustrated in detail in FIGS. 2-10 for purposes of dislodging the mask 20 from its illustrated position of use against the face and thereby enabling the pilot to breathe independently of the mask 20. Accordingly, the bayonet receiver not shown in FIG. 1 and mounted on the side of helmet 10 opposite bayonet receiver 48 can be and is of conventional design.

Figure 2:
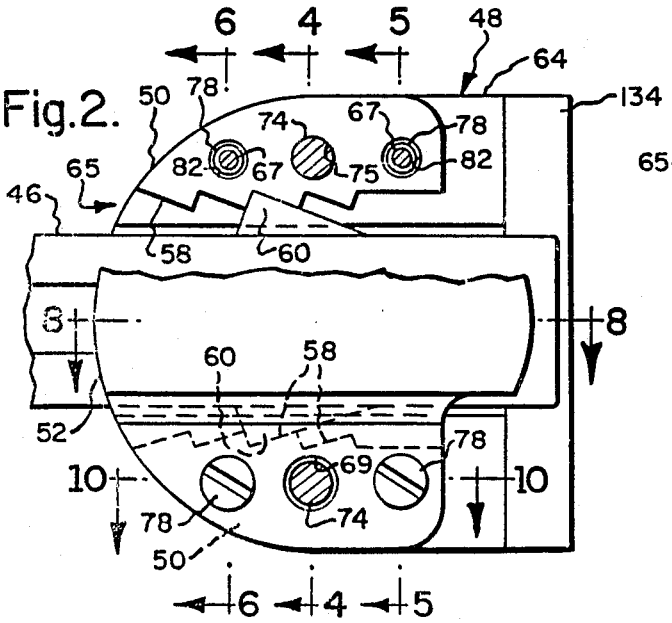
FIG. 2 is a fragmentary elevational view, shown partially broken away, of the bayonet receiver and automatic release mechanism of the helmet of FIG. 1 taken about on line 2—2 of FIG. 6.
Figure 4:
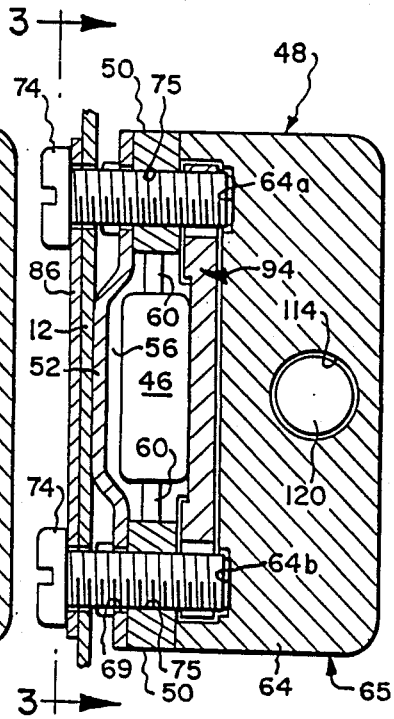
FIG. 4 is a transverse sectional view of the bayonet receiver and automatic release mechanism taken about on line 4—4 of FIG. 2, the bayonet being shown in outline form for ease of illustration.

As shown in FIG. 2, bayonet receiver 48 includes a pair of opposed jaw members 50 positioned between a cover plate 52 and an actuator body 64, hereinafter described, defining, between the opposed jaw members 50, a bayonet-receiving channel 56 (FIG. 4). Jaw members 50 have a series of teeth 58 extending along channel 56 and adapted to be engaged by spring-loaded fingers or ears 60 carried by the bayonets 46 and normally extending from opposite sides thereof. In practice, the pilot manually pushes the bayonets 46 into the channels 56 of the receivers mounted on opposite sides of the helmet 10 until mask 20 is snugly positioned against his face. Fingers 60 interlock with teeth 58 to releasably secure mask 20 in such position of use. When the pilot wishes to manually release the mask 20 from its position of use against his face, he grasps the turned end 62 (FIG. 1) of a release bar lever carried by each bayonet 46 and pushes it forwardly toward the mask 20, the bayonets 46 typically having an internal wedging mechanism (not shown) for retracting ears 60 when this is done. Such manually activated bayonet release arrangements being conventional and well understood in the art, further description thereof is believed unnecessary.

Mask 20 and its attaching harness including bayonets 46 are conventional, and the conventional bayonet receiver not shown in FIG. 1 includes a bayonet-receiving channel and spring finger interlock comparable in construction to that indicated 58,58 in FIG. 2. However, receiver 48 mounted on the side of helmet 10 shown in FIG. 1 is provided in addition with an automatic release mechanism of this invention, hereafter described, while the receiver mounted on the opposite side of helmet 10 is not.

Figure 6:
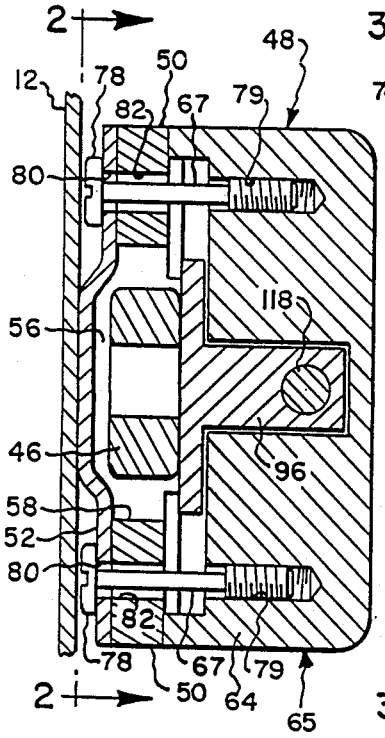
FIG. 6 is a transverse sectional view thereof taken about on line 6—6 of FIG. 2.
Figure 5:
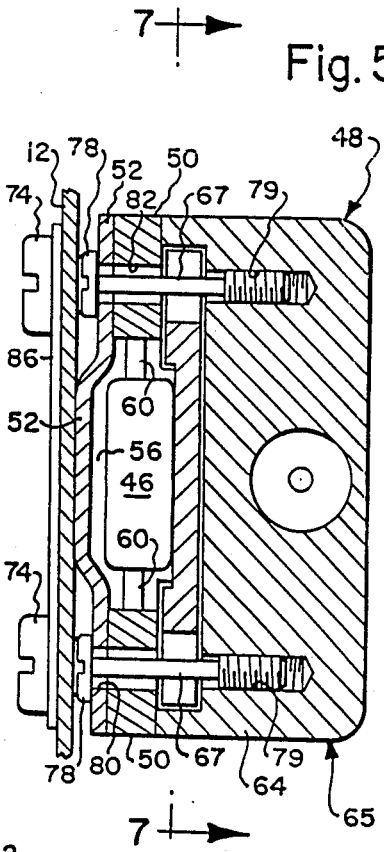
FIG. 5 is a transverse sectional view thereof taken about on line 5—5 of FIG. 2, the bayonet being shown in outline form for ease of illustration.

Referring now to FIGS. 2–7, there is shown an automatic release mechanism, generally indicated 65, in accordance with the present invention and incorporated in the receiver 48. The release mechanism 65 includes the actuator body 64, introduced earlier, positioned on the side of bayonet 46 and the bayonet receiving channel 56 opposite cover plate 52 and helmet shell 12. As best shown in FIG. 2, the actuator body 64 and plate 52 possess substantially the same plan view profile except for rearward locations at which cover plate 52 is cut away. The actuator body 64 defines four threaded bores 79 which are aligned with clearance holes 80 and 82 (FIG. 6) defined in plate 52 and jaw members 50, respectively, and which threadably receive the threaded shanks of mounting screws 78. As best shown in FIG. 6, the shank of each screw 78 extends through clearance holes 80,82 and is threaded in the bore 79 so that plate 52 and jaw members 50 are tightly held together in assembled relation between actuator body 64 and the heads of the mounting screws 78. The shank of each mounting screw 78 is necked down to the root diameter of the screw as shown in FIGS. 5 and 6 so that the portion, indicated 67, of the screw shank which protrudes from the threaded bore 79 is cylindrical in shape and absent of threads for a purpose to be described.

With reference to FIG. 4, the assembled actuator body 64, jaw members 50 and plate 52 are held against the shell 12 of helmet 10 by means of a pair of mounting bolts 74. To this end, the jaw members 50 define a pair of threaded bores 75 which are aligned with clearance holes 69 in plate 52 and corresponding mounting holes in the helmet shell 12 and a backing plate 86 (FIG. 3) and which threadably receive the shanks of mounting bolts 74. Furthermore, the actuator body 64 defines a pair of circular recesses **64*a*, 64*b* as illustrated in FIG. 4 for receiving the ends of the shanks of the mounting bolts 74. Such recesses 64*a*,64*b* may be desired in some instances (if, for example, actuator body 64 were constructed of a lightweight metal) to help hold the body 64 in a stationary relationship with respect to the helmet shell 12 in opposition to reactive forces which may be generated upon actuation of the mechanism 65 as will be described presently. Backing plate 86 is positioned against the inner wall of the shell 12 so that the shank of each mounting bolt 74 extends, in sequence, through backing plate 86, helmet shell 12, plate 52, jaw members 112 and into recess 64*a* or 64*b*, while the heads of the bolts 74 are positioned inside helmet 10. When bolts 74 are tightened within the jaw member bores 75, as shown in FIG. 4, backing plate 86 bears against the inner wall of the shell 12 and the assembly comprised of actuator body 64, jaw members 50 and plate 52 is secured against shell 12**.

It is a particular feature of this invention that the automatic release mechanism 65 operates without explosively propelling bayonet 46 or any component of release mechanism 65 from helmet shell 12. Such a feature is advantageous in that any likelihood that damage or harm to persons or property adjacent helmet 10 may result from activation of release mechanism 65 is substantially reduced. While the possibility of any resulting damage or harm is considered to be very remote, such an advantage can be readily appreciated if there is any likelihood of mechanism 65 being accidently activated while, for example, helmet 10 is being handled.

In accordance with the present invention, release mechanism 65 incorporates means for severing mounting screws 78 at such a location along the length thereof that actuator body 64 is separated from the jaw members 50 and is permitted to fall under its own weight away from the corresponding side of helmet 10. The severing action facilitates such separation. When this occurs, bayonet 46 no longer is confined to its receiving channel 56 and is enabled to move from its location between the jaw members 50 utilizing the resilient compression of mask 20 against the face to facilitate such separation.

Figure 8:
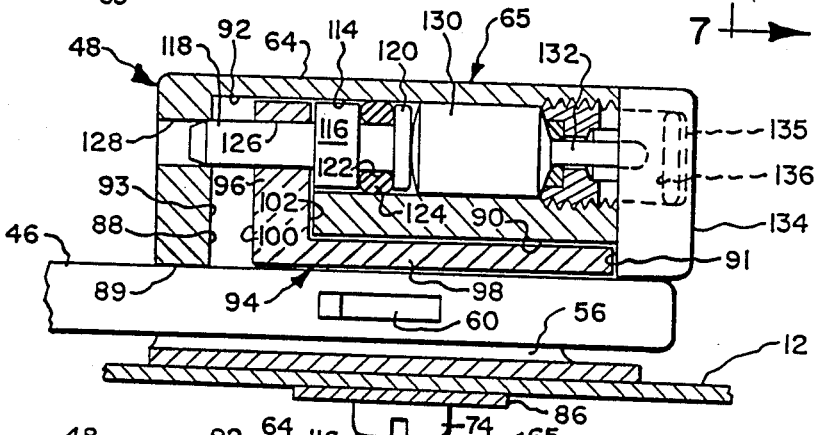
FIG. 8 is a longitudinal sectional view thereof taken about on line 8—8 of FIG. 2 and illustrating the relative positioning of components of the release mechanism before actuation thereof.
Figure 9:
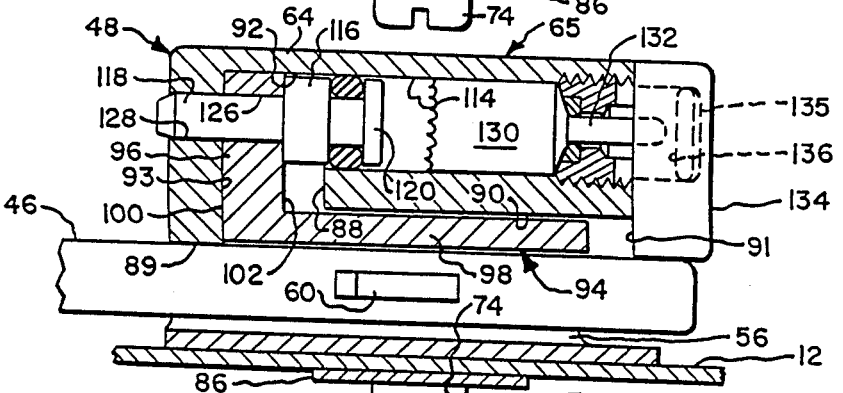
FIG. 9 is a view similar to that of FIG. 8 illustrating the relative positioning of the components after actuation of the mechanism.

To this end, and with reference to FIGS. 8 and 9, actuator body 64 is provided with an elongated cavity 88 collectively defined by contiguous recesses 90,92 in the body side, indicated 89, facing bayonet 46 and its receiving channel 56. As shown in FIG. 8, recess 90 is relatively shallow in depth and recess 92 is relatively deep. For a reason which will be apparent hereinafter, one end of the cavity 88 is indicated 91 and the opposite end of the cavity 88 is indicated 93.

The mechanism 65 further includes a cutter 94 positioned within cavity 88 for sliding movement between the cavity ends 91,93 and for completely severing mounting screws 78 upon actuation of the mechanism. The cutter 94 includes a head portion 96 and a platen-like blade portion 98 attached to the head portion 96. Each of the cutter head portion 96 and blade portion 98 are of such size and shape that when operatively positioned within cavity 88, the cutter head portion 96 is slidably received within recess 92 and the blade portion 98 is slidably received within the recess 90. Accordingly, the transverse cross-sectional shapes of cutter head portion 96 and blade portion 98 are slightly smaller than those of recess 92,90, respectively. Furthermore, and as illustrated in FIG. 8, the length of head portion 96 as measured between its opposite faces 100,102 is substantially less than the length of recess 92 as measured from the cavity end 93 so as to permit substantial lengthwise movement of cutter 94 relative to and along cavity 88.

Figure 7:
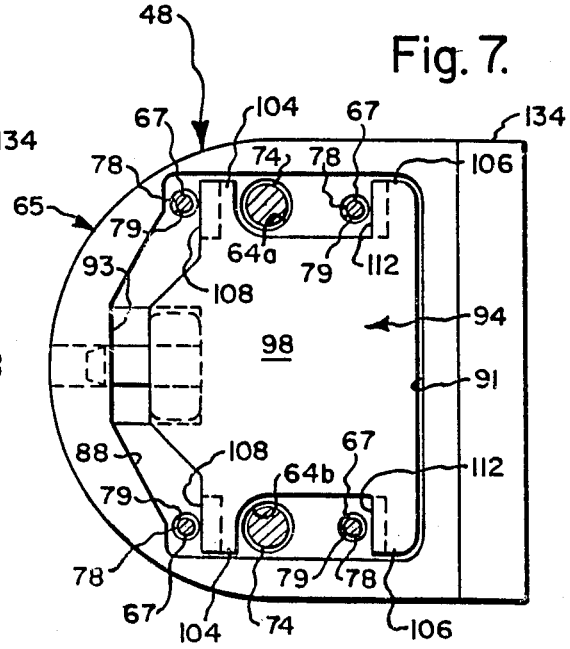
FIG. 7 is a cross-sectional view of the bayonet receiver and automatic release mechanism taken about on line 7—7 of FIG. 5.
Figure 10:
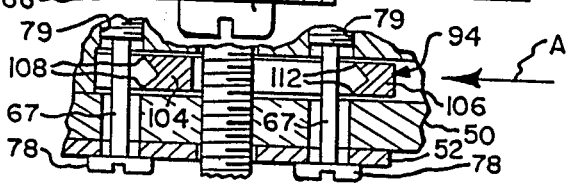
FIG. 10 is a longitudinal sectional detail view taken about on line 10—10 of FIG. 2.

As viewed in FIG. 7, the blade portion 98 of cutter 94 is somewhat H-shaped so as to define a first pair of legs 104 and a second pair of legs 106. The cutouts defined between the legs 104 and 106 provide clearance for the shank ends of the mounting bolts 74 if the latter protrude therein when tightened, thereby avoiding binding interference with movement of cutter 94. Each leg 104 of the first leg pair is positioned adjacent and to the right of, as viewed in FIG. 7, the threadless shank portion 67 of the corresponding mounting screw 78 and includes a pair of sharpened cutting edges 108, as best shown in FIG. 10, which generally face the screw shank portion 67. Each leg 106 of the second leg pair is positioned adjacent and to the right of, as viewed in FIG. 7, the threadless shank portion 67 of the corresponding mounting screw 78 and includes a pair of sharpened cutting edges 109, as best shown in FIG. 10, which generally face the screw shank portion 67.

Before actuation of the automatic release mechanism 65 and with reference to FIGS. 7, 8 and 10, cutter 94 is positioned adjacent the cavity end 91 and each pair of cutting edges 108, 112 of blade portion 98 is positioned closely adjacent the corresponding mounting screw 78 for severing the latter when cutter 94 is forcibly driven from the cavity end 91 toward the cavity end 93 in a manner hereinafter described.

With reference to FIGS. 4 and 8, actuator body 64 is provided with a cylindrical aperture or bore 114 extending longitudinally of body 64 and generally parallel to the centerline of the bayonet-receiving channel 56. Mounted within bore 114 is a ram 120 having a cylindrical head 116 which is slidably received by bore 114 and a cylindrical shank 118 extending from one end of ram head 116 into and through cavity 88. The ram head 116 defines an annular groove 122 therearound, and an O-ring 124 is positioned within the groove 122 to prevent the passage of gas between the surfaces of bore 114 and ram head 116. The shank 118 of the ram 120 is force-fitted within a through opening 126 defined in cutter head portion 96 and is slidably received within a guide opening 128 through the end of actuator body 64 which defines cavity end 93. The openings 126 and 128 are oriented so that the longitudinal axes thereof coincide with one another and with the longitudinal axis of bore 114. It follows from the foregoing that movement of ram 120 relative to and along the length of bore 114 as the ram shank 118 is slidably guided along the opening 128 moves cutter 94 from cavity end 91 to cavity end 93.

Driving force for ram 120 is provided by an explosive shock type primer or cartridge 130 positioned within bore 114 adjacent the face of ram head 116 opposite cutter head portion 96. Explosive cartridge 130 can be like the cartridge provided in U.S. Pat. No. 4,024,440, and has a conductor 132 connected to an activating or control circuit, schematically indicated at 136 in FIG. 8, contained within a housing 134 across the rearward end of actuator body 64. The activating circuit 136 includes means for sensing the occurrence of a predetermined event, for example the presence of water, and acts in response to such sensing to electrically trigger the explosive cartridge 130, detonating it and thereby generating high pressure gases within bore 114. This creates an immense inertial or explosive shock wave acting upon ram head 116. The extremely high pressure of the gas generated by exploding cartridge 130 drives ram 120, and with it cutter 94, axially of bore 114 with great force from the position shown in FIG. 8 to the position shown in FIG. 9.

As ram 120 is driven along the bore 114 from the position of FIG. 8 to the position of FIG. 9, the cylindrical surfaces of ram head 116 and ram shank 118 cooperate with their respective bore and guide passage walls to prevent a canting or cocking of ram 120 in bore 114, thereby ensuring axial movement of ram 120 and cutter 94 as intended.

With reference to FIG. 10, as cutter 94 is driven by ram 120 from the gas force generated by exploding cartridge 130, the cutting edges 108,112 of the cutter blade portion 98 are driven in the direction of the arrow A through the shank portions 67 of mounting screws 78 to completely sever each of mounting screws 78 between its head and the threaded end thereof. Such severance is facilitated by the fact that the cutting edges 108,112 of the cutter 94 act upon the shank portions 67 adjacent the threaded portion of the screws 78 fixed within the bores 79 of actuator body 64. The severance of screws 78 is effected by what is believed to be a chopping action of the cutting edges 108,112 as they are driven against and through two locations on the shank portions 67 under the influence of the generated explosive force. The necking down of thread-free shank portions 67 avoids chatter and possible cocking of cutter 94 such as might occur if portions 67 were threaded and the cutting edges were aligned with the outer edge of the thread on one mounting screw and the root diameter of another mounting screw.

Further, and with reference to FIG. 10, a section of each shank portion 67 is effectively separated from the opposite ends of corresponding screw 78 by the cutting edges 108 or 112 in a manner severing each shank portion 67 clearly along a radial plane thereof, which radial plane is substantially concident to, or slightly offset from, the outermost surface of the jaw members 50. Because the cut surface of each shank portion 67 closest to the jaw members 50 is rendered clean and thus relatively smooth by the aforedescribed severing action, the portion of the screws 78 remaining attached to the helmet 10 with the jaw members 50 is absent a sharp, protruding end which could otherwise pose a hazard to objects proximate the helmet such as, for example, an inflated life vest which the aviator may be wearing. Effective severing of fasteners 78 also is facilitated by the afore-described recesses **64*a*,64*b* which hold body 64 and thus fasteners 78 stationary and in opposition to any reaction forces which otherwise might interfere with the severing action of cutter 94 against the fasteners shank portions 67**.

With mounting screws 78 severed as aforesaid, actuator body 64 is free to fall away from the jaw members 50 under its own weight. More specifically, with the mounting screws 78 severed, actuator body 64 falls from the receiver components which remain affixed to helmet shell 12 removing the outer defining wall of the bayonet-receiving channel 56 and thereby exposing bayonet 46 and enabling it to move outwardly from between the jaw members through the open side created in the bayonet-receiving channel 56. While this normally would be expected to result from any of a variety of factors surrounding the construction and use of the mechanism, it is another feature of this invention that advantage is taken of the tension forces on harness straps 36, produced by the resilient compression of nosepiece 24 against the face of the user. Such nosepiece customarily includes a resilient flap indicated at 25 and forms a resilient seal against the face when the mask is in use. This exerts a tensioning force on straps 36, in a direction angled inwardly from receiver 48 toward mask 20, which force tends to rock the bayonet outwardly from between jaw members 50 when the receiver components are separated. Bayonet 46 thereby moves from its position of use in receiver 48 between jaw members 50 through the created open side of the channel 56 to thereby separate one side of mask 20 from its corresponding side of helmet 10. With the mask 20 separated from helmet 10 as aforesaid, the nosepiece formation 24 shifts from its position of use against the wearer's face and the wearer is permitted to breathe independently of mask 20.

An advantage provided by release mechanism 65 of this invention resides in the fact that the explosive force and action are largely contained within and confined to the bayonet receiver. To this end, the assembled receiver components 65, 50 and 52 effectively provide an enclosure for containing the explosive force and action. Neither bayonet 46 nor any components of the receiver 48 are propelled from helmet 10 by the explosive force generated upon actuation of the mechanism 65. Furthermore, the explosive force generated by the cartridge 130 is channeled substantially axially of the actuator body bore 114 and along a path directed generally tangentially of helmet shell 12 so that the likelihood is minimal that receiver components which are separated by the explosive force of the cartridge 130 will be forcibly thrown outwardly and away from the helmet shell 10. At the same time, the positive action of explosive activation is retained, and the arrangement and operation are such that receiver body 64 does separate by its own weight to expose the bayonet 46, and the latter does move outwardly from between the jaw members, being urged outwardly by the resilient tension forces on the mask harness straps.

With reference again to FIG. 8, the activating circuit 136 contained within housing 134 is one which is responsive to a predetermined event such as, for example, immersion in water and typically is characterized by a charging circuit including a battery power source and a firing capacitor in a charging circuit which is completed, for example by immersion of sensors in water. The actuator body 64, which typically is of aluminum, can be one such sensor and another sensor 135 can be carried by the circuit-enclosing body 134 so as to sense the presence of a fluid medium surrounding the receiver 48 both sensors being electrically connected to circuit 136. The firing capacitor is discharged through the primer cartridge 130 to detonate the same, such discharge occurring as determined by the control circuit 136. For example, it could occur upon immersion in water, in which event a circuit of the type shown in U.S. Pat. No. 4,024,440 could be used. Reference is made to that patent for details of such a circuit. The control circuit 136 also can incorporate a time delay circuit to permit the aviator to use the supply of air initially trapped in hose 28 upon immersion in water, and indeed the circuit can include an arrangement such that firing does not occur until the helmet emerges from the water. Housing 134 can be secured to actuator body 64 by screws (not shown) or other suitable means.

Accordingly, it is seen that the instant invention fully accomplishes its intended objects, providing an explosively activated automatic release mechanism operable to separate components of the bayonet receiver 48 from one another and thereby cause the bayonet to separate from helmet 10. This is accomplished by the use of an explosive actuator, activated upon the occurrence of a preselected event such as immersion in water or emergence therefrom, and, when activated, driving cutter 94 with tremendous force to completely sever mounting screws 78 and thereby separate actuator body 64 from the jaw members 50. With actuator body 64 separated from the jaw members 50, bayonet 46 moves from between the jaw members to accomplish the desired separation of the mask from helmet 10. The instant invention is further advantageous in that no modification of the mask-connecting harness or bayonet assembly is required, and the standard bayonet-receiving cover plate and jaw members can be used, the automatic release mechanism having substantially the profile of a standard receiver and requiring only a relatively modest and commonly acceptable increase in the height thereof on the helmet shell. The foregoing also is accomplished in a manner completely independent of the manual release mechanism associated with the receiver, which mechanism remains fully operable in the customary, intended manner.

It will be understood that numerous modifications and substitutions can be had to the aforedescribed embodiment without departing from the spirit of the invention. Accordingly, the aforedescribed embodiment is intended for the purpose of illustration and not as limitation.

We claim:

1. An apparatus for automatically releasing a breathing mask from a protective head-enclosing helmet to permit the wearer to breathe independently of the mask upon the occurrence of a predetermined event, wherein said mask and helmet include coacting means for releasably securing the mask to the helmet in a position of use against the wearer's face and wherein said apparatus includes explosively-activated means operatively associated with said coacting means and means responsive to the occurrence of the predetermined event for actuating said explosively-activated means, said coacting means separating upon actuation of said explosively-activated means in a manner freeing the mask from the helmet without being forceably propelled away from the helmet by the explosive force of said explosively-activated means, wherein said coacting means includes a bayonet and a bayonet receiver, said bayonet being attached to one of said mask and helmet and said bayonet receiver being attached to the other of said mask and helmet, said bayonet receiver including a plurality of components arranged in assembled relationship so as to define a bayonet-receiving channel adapted to interlock with said bayonet when said bayonet is operatively accepted by said channel, and holding means for holding said receiver components in the aforesaid assembled relationship, said coacting means including cutter means operatively interposed between said explosively-activated means and said holding means for severing said holding means upon activation of said explosively-activated means to thereby separate components of said receiver from one another to enable the escape of said bayonet from said bayonet-receiving channel.

2. The apparatus of claim 1 wherein said bayonet receiver is adapted to channel the explosive force of said explosively-activated means so that said bayonet is not directly acted upon by the explosive force generated by said explosively-activated means or the consequent severance of said holding means.

3. The apparatus of claim 1 wherein said mask includes a face-contacting cushion of resilient material which is in a compressed condition against the face of the wearer when said mask is in its position of use and separation of the components of said receiver enables the resilient force exerted by said face-contacting cushion to urge said bayonet outwardly away from said bayonet-receiving channel.

4. The apparatus of claim 1 wherein said bayonet receiver defines an enclosure for the explosive force generated by said explosively-activated means such that the explosive force is substantially confined within said bayonet receiver enclosure upon activation of said explosively-activated means.

5. The improvement of claim 1 wherein said holding means includes a shanked fastener joining said receiver components together and said cutter means severs the shank of said fastener.

6. The apparatus of claim 8 wherein said shanked fastener has a threadless, intermediate cylindrically-shaped portion aligned with said cutter means and said cutter means severs the cylindrically-shaped portion of the fastener shank.

7. The apparatus of claim 5 wherein one of said receiver components includes an actuator body and said cutter means includes a cutting blade having a cutting edge mounted within said actuator body for movement relative thereto when said explosively-activated means is activated to effect a severance of the fastener shank by said cutting edge.

8. The apparatus of claim 6 wherein said cutter means is adapted to sever said intermediate portion of the fastener shank cleanly through a radial plane thereof.

9. The improvement of claim 1 wherein said holding means includes a plurality of shanked fasteners joining said receiver components together and said cutter means is adapted to sever every shank of said plurality of fasteners upon actuation of said explosively-activated means.

10. The improvement of claim 9 wherein each shanked fastener has a cylindrically-shaped portion aligned with said cutter means and said cutter means severs the cylindrically-shaped portion of every fastener shank.

11. The improvement of claim 4 wherein said bayonet receiver includes an actuator body into which the shank of said fastener extends and said cutter means includes a cutting blade mounted within said actuator body for movement relative thereto through the fastener shank to effect a severance thereof when said explosively-activated means is activated.

12. An apparatus for automatically releasing a breathing mask from a protective head-enclosing helmet to permit the wearer to breathe independently of the mask upon the occurrence of a predetermined event wherein said mask and helmet include coacting means for releasably securing the mask to the helmet in a position of use against the wearer's face and wherein said apparatus includes explosively-activated means operatively associated with said coacting means and means responsive to the occurrence of the predetermined event for actuating said explosively-activated means, wherein said coacting means includes a bayonet attached to said mask and a bayonet receiver carried by said helmet, said bayonet receiver including components held together in assembled relation, and wherein said explosively-activated means acts upon said bayonet receiver independently of said bayonet in a manner separating components of said receiver so that upon separation thereof, said bayonet separates from said helmet.

13. The apparatus of claim 12 wherein said coacting means substantially confine the explosive force of said explosively-activated means in a manner precluding the forcible propulsion of said coacting means from the helmet.

14. The apparatus of claim 13 wherein said coacting means define an enclosure for the explosive force so that the explosive force is substantially confined within said enclosure.

15. The improvement of claim 12 wherein said receiver components include an actuator body, a plate, a pair of jaw members sandwiched between said actuator body and said plate so as to define with said plate and actuator body a bayonet receiving channel, and holding means for holding said body, jaw members and plate together in assembled relationship, said bayonet-receiving channel adapted to releasably hold said bayonet when said bayonet is inserted within said channel, said explosively-activated means acting upon said bayonet receiver so as to sever said holding means when said explosively-activated means is activated and to thereby destroy the bayonet-holding capacity of said channel.

16. The improvement of claim 15 wherein said holding means is in the form of at least one shanked fastener joining the receiver components together and the severance of said holding means severs the shank of said fastener.

17. The improvement of claim 15 wherein said coacting means includes cutter means in the form of a cutting blade, said actuator body defines an elongated cavity within which said cutting blade is mounted for sliding movement relative thereto between one cavity end and the other cavity end, and said cutting blade is adapted to be forcibly driven by the explosive force of said explosively-activated means between said cavity ends and arranged relative to said holding means so that as said cutting blade is driven between said cavity ends as aforesaid, said holding means is completely severed by said cutting blade.

18. Apparatus as defined in claim 17 wherein said bayonet receiver is attached to the outer surface of the helmet when the bayonet is operatively received by said bayonet receiving channel so that said bore and said elongated cavity of said actuator body are oriented generally tangentially of said helmet so that the inertial shock of said explosive charge is channeled generally tangentially of the helmet.

19. The improvement of claim 17 wherein said actuator body defines a bore being in communication with said elongated cavity and said explosively-activated means includes an explosive charge supported within said bore and adapted to be detonated upon activation of said explosively-activated means, said cutting blade being arranged relative to said bore so that when said explosive charge is detonated, said cutting blade is forcibly driven between said cavity ends by the inertial shock generated by said charge.

20. The improvement of claim 19 wherein the longitudinal axes of said bore and said elongated cavity are oriented generally parallel to one another so that as said cutting blade is forcibly driven between said cavity ends, said cutting blade moves axially of said bore.

21. The improvement of claim 20 wherein said actuator body is arranged relative to the helmet when the mask and helmet are operatively secured so that said longitudinal axes are oriented generally tangentially of the helmet and so that a substantial portion of the inertial shock generated by the explosive charge is channeled generally tangentially of the helmet.

22. The improvement of claim 15, wherein said body falls from said receiver under its own weight upon severance of said holding means, thereby exposing said bayonet and enabling it to move outwardly from said channel.

23. Apparatus for automatically releasing a breathing mask from a protective head-enclosing helmet to permit the wearer to breathe independently of the mask upon the occurrence of a predetermined event comprising:

means defining a bayonet attached to one of the mask and helmet;

means defining a bayonet receiver attached to the other of the mask and helmet and including components defining a bayonet-receiving channel for accepting said bayonet in interlocking relation with said receiver, said bayonet receiver further including means for holding said receiver components in assembled relationship;

explosively-activated means operatively associated with said bayonet receiver;

means responsive to the occurrence of the predetermined event for activating said explosively-activated means; and cutter means interposed between said explosively-activated means and said holding means for severing the latter in response to the activation of said explosively-activated means whereby said receiver components separate and said bayonet thereupon separates from said receiver.

24. Apparatus as defined in claim 23 wherein said bayonet receiver includes an actuator body within which is defined an elongated cavity and which is held in assembled relationship with the remainder of said receiver components by means of a shanked fastener extending generally transversely of and through said elongated cavity, said cutter means includes means further defining blade means positioned within said elongated cavity for sliding movement relative thereto between the cavity ends and adapted to be forcibly driven relative to and along the length of said cavity when said explosively-activated means is activated; said blade means defining a cutting edge positioned in condition for cutting the shank of said fastener so that as the blade means is driven from one end of the cavity to the other cavity end, said cutting edge is driven through the fastener shank to effect a complete severance thereof.

25. Apparatus as defined in claim 24 wherein the explosive force of said explosively-activated means is substantially confined within said actuator body.

26. Apparatus as defined in claim 24 wherein said blade means is arranged in such a relationship with said fastener shank so that said fastener shank is cleanly severed through a radial plane thereof by the cutting edge of the blade means as the blade means is driven from one end of the cavity to the other cavity end.

27. Apparatus as defined in claim 24 wherein said bayonet receiver includes a plate and jaw members held in assembled relationship with said actuator body so that said jaw members are sandwiched between said plate and said actuator body, said holding means includes at least one shanked fastener for holding said actuator body in assembled relationship with said plate and jaw members and each fastener extends generally transversely of and through said elongated cavity, said blade means includes means defining cutting edges positioned in condition for severing the shank of each fastener so that as the blade means is driven from one cavity end to the other cavity end, said cutting edges are driven through so as to completely sever each fastener shank and said actuator body is permitted to separate from said jaw members and plate in a manner permitting said bayonet to separate from said bayonet-receiving channel.

28. The improvement of claim 24, wherein there are a plurality of such fasteners spaced longitudinally of said cavity, said cutter having longitudinally spaced blade means associated with said fasteners and being recessed between said longitudinally spaced blade means to accomodate helmet attaching means without binding said cutter means.

29. Apparatus as defined in claim 27 wherein said actuator body defines a bore oriented therein so that its longitudinal axis is generally parallel to the longitudinal axis of said elongated cavity and which communicates at one end with said elongated cavity, said explosively-activated means includes an explosive charge mounted within said bore and said blade means includes a head portion positioned adjacent the cavity-end of said bore for receiving the inertial shock of the explosive charge when detonated so that said blade means is forcibly driven axially of the bore upon actuation of said explosively-activated means from one end of the elongated cavity to the other cavity end.

30. The improvement of claim 29, together with a ram carried by said head portion, said ram having a head positioned to receive said inertial shock and a shank, together with means in said body defining a guide opening receiving said ram shank.

31. An apparatus for automatically releasing a breathing mask from a protective head-enclosing helmet to permit the wearer to breathe independently of the mask upon the occurrence of a predetermined event, wherein said mask and helmet include coacting means for releasably securing the mask to the helmet in a position of use against the wearer's face and wherein said apparatus includes explosively-activated means operatively associated with said coacting means and means responsive to the occurrence of the predetermined event for actuating said explosively-activated means, said coacting means separating upon actuation of said explosively-activated means in a manner freeing the mask from the helmet without being forceably propelled away from the helmet by the explosive force of said explosively-activated means, wherein said coacting means includes a bayonet and a bayonet receiver, said bayonet being attached to one of said mask and helmet and said bayonet receiver being attached to the other of said mask and helmet, said bayonet receiver including a plurality of components arranged in assembled relationship so as to define a bayonet-receiving channel for interlocking said receiver and said bayonet together when said bayonet is operatively accepted by said channel, and holding means for holding said receiver components in the aforesaid assembled relationship, said explosively-activated means adapted to sever said holding means and thereby destroy the component-holding capacity of said holding means when said explosively-activated means is activated to enable the receiver components to separate from one another and thereby permit the mask to separate from the helmet.

32. The improvement of claim 31 wherein said holding means includes a shanked fastener joining said receiver components together, and said coacting means includes cutter means interposed between the explosively-activated means and the shank of said fastener for receiving the explosive force of said explosively-activated means and for severing the fastener shank in response to the received explosive force.

* * * * *